US006129153A

United States Patent [19]

Joung

[11] Patent Number: 6,129,153

[45] Date of Patent: Oct. 10, 2000

[54] WATER SPRAYING CONTROL UNIT FOR A FIRE EXTINGUISHING SPRINKLER HEAD

[76] Inventor: In Jin Joung, 276-19, Poongnap 2 dong, Songpa Gu, Seoul, Rep. of Korea

[21] Appl. No.: 09/261,320

[22] Filed: Mar. 3, 1999

[51] Int. Cl.[7] ..... A62C 37/08

[52] U.S. Cl. ..... 169/37; 169/41

[58] Field of Search ..... 169/37, 41; 239/506

[56] References Cited

U.S. PATENT DOCUMENTS

| | | | |
|---|---|---|---|
| 489,342 | 1/1893 | Stratton | 169/41 |
| 495,337 | 4/1893 | Holmes | 169/41 |
| 4,066,129 | 1/1978 | Anderson | 169/37 |
| 4,217,960 | 8/1980 | Miyazaki . | |
| 4,508,175 | 4/1985 | Pieczykolan . | |
| 4,618,002 | 10/1986 | Mears | 169/37 |
| 4,660,648 | 4/1987 | Zen | 169/37 |
| 4,715,447 | 12/1987 | Johnson | 169/37 |
| 4,977,963 | 12/1990 | Simons | 169/37 |
| 5,094,298 | 3/1992 | Polan | 169/41 |
| 5,234,059 | 8/1993 | Eynon | 169/37 |

*Primary Examiner*—Andres Kashnikow
*Assistant Examiner*—Christopher S. Kim
*Attorney, Agent, or Firm*—Flynn, Thiel, Boutell & Tanis, P.C.

[57] ABSTRACT

A water spraying control unit includes a fire extinguishing sprinkler head. The sprinkler head receives a branch pipe from a pipe line arranged in the ceiling of a building and the sprinkler head suppresses fire by discharging pressured water due to separation of a heat sensing plate and a nut supporting plate from the sprinkler head during a fire. A water spraying plate is joined with a water spraying plate bolt. The water spraying plate bolt is able to move through a through hole of a protruding portion in the outside of the sprinkler head. During a fire, the heat sensing plate and the nut supporting plate melt, enabling the water spraying plate to move downwardly thus opening a path for the pressurized water, the water spraying plate spraying the water over a wide area. Thus, a sprinkler head stored in the ceiling of a building is able to lower itself when actuated and spray water over a large area. In this manner, the sprinkler head is not viewable unless used, and thus aesthetically improves the interior of the building.

17 Claims, 5 Drawing Sheets

WATER SPRAYING CONTROL UNIT FOR A FIRE EXTINGUISHING SPRINKLER HEAD

FIELD OF THE INVENTION

This invention relates to a water spraying control unit for a fire extinguishing sprinkler head, particularly a unit for preventing a flame from spreading to the ceiling or the wall surface during a fire breakout. The water spraying control unit diversifies the water spraying plate of a sprinkler head, and also spreads the spraying direction of water to a wide area by protruding a spraying plate of the sprinkler head downwards to extinguish the fire at the time of fire breakout. The sprinkler head of the invention usually keeps a level plane without any protrusion from the finished ceiling material by attaching a water spraying plate to the sprinkler head.

BACKGROUND OF THE INVENTION

Generally, a sprinkler is installed at the inside and/or the outside of a building and/or a factory so as to prevent a fire from spreading and simultaneously to extinguish the fire easily.

Such a sprinkler usually is arranged at the ceiling area of a building and is operated in conjunction with a temperature sensor. However, lots of difficulties have always arisen because of the limited ceiling height and the interior accommodations depending on the installing method and the type of sprinkler head.

In other words, in a conventional sprinkler system, the sprinkler head, which has been arranged in a ceiling around a pipe line, can be melted or burst due to the atmosphere temperature rising because of a flame produced during a fire breakout, so that water pressurized in the pipe can be discharged and therefore automatically extinguish the fire.

In connection with the above, there is a problem that the sprinkler should protrude through the installed ceiling material at its final installing stage, since a conventional sprinkler head is formed as an integral structure mounted fixedly by the spray nozzle and the spraying plate.

SUMMARY OF THE DISCLOSURE

This invention solves the above mentioned problem, wherein the final installation of a sprinkler head for fire extinguishing can be arranged without any protrusion from the finished ceiling material. During a fire breakout, the water spraying plate is instantly actuated at a certain distance through separation of the heat sensing plate from the nut supporting plate. The water spraying plate is also lowered down to be fixed, so that a device for controlling the water spraying plate of a sprinkler head for the fire extinguishing purpose can be provided to carry out an extinguishing function by simultaneously spraying a large quantity of water to a wide area.

This device, according to the present invention, is branched off from the pipe lines which have been arranged at the upper area of the ceiling in a building and/or in a factory. During a fire breakout, a heat sensing plate and a nut supporting plate are separated, so that the sprinkler head for the fire extinguishing purpose can suppress a fire by discharging the water which is always kept in a pressurized condition. The packing plate also shuts off discharging of water outwards, as arranged at the inside of a sprinkler head. A fastening center bolt is conjoined to the reinforced plate and the nut to be coupled at the inside of a sprinkler head.

After attaching the water spraying plate to an end part of the sprinkler head, the nut supporting plate integrally combined with the heat sensing plate is joined to the nut using a nut support accessible slot of the sprinkler head. Then each side wing of the nut supporting plate will be fixed by turning the plate an approximately 90° angle, in order that the plate may be suspended on the slot for the inner nut support of the sprinkler head. Finally, a water spraying plate and a water spraying bolt can be combined together, after tightening the fastening center bolt using a screw driver through the center hole formed on the central portion of a heat sensing plate.

At a fire breakout, a lead, such as a melting material, is melted due to the temperature increasing and so a heat sensing plate and a nut supporting plate are separated. As a result, the nut which supports a packing plate and a reinforced plate loses its function. Therefore, through the discharging water along the guiding pipe line, the water spraying plate of a sprinkler is instantly actuated within a certain distance, and lowered down up to a length of the water spraying plate to be fixed. Thus the device carries out the fire extinguishing function by spraying a large quantity of water to the wide area.

BRIEF DESCRIPTION OF THE DRAWINGS

This and other objects of the present invention will become readily apparent upon reading the following specification and upon reference to the accompanying drawings.

DETAILED DESCRIPTION OF THE INVENTION

Figure 1A:
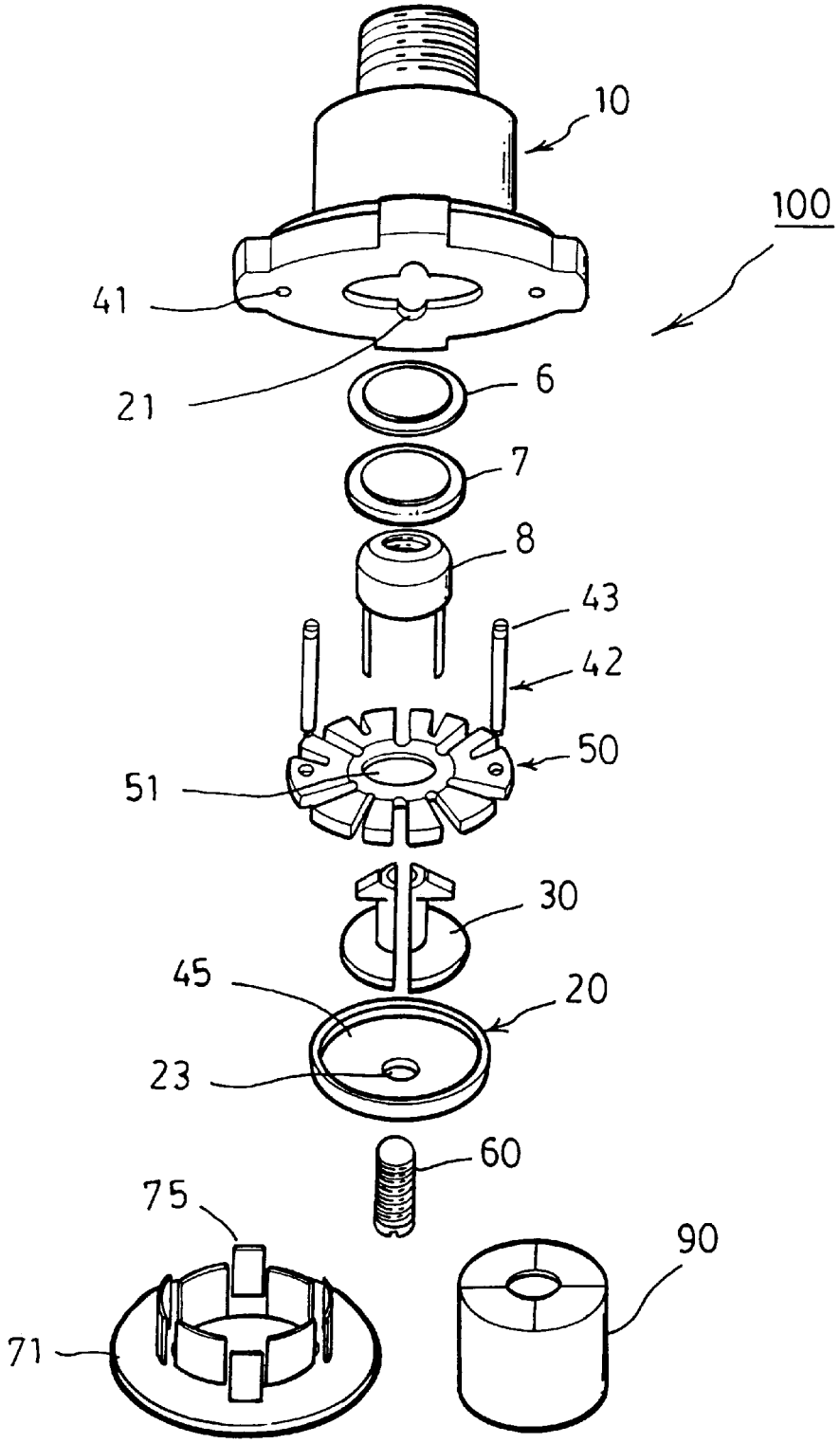
FIG. 1*a* is an exploded perspective view of a device according to the present invention.
Figure 1B:
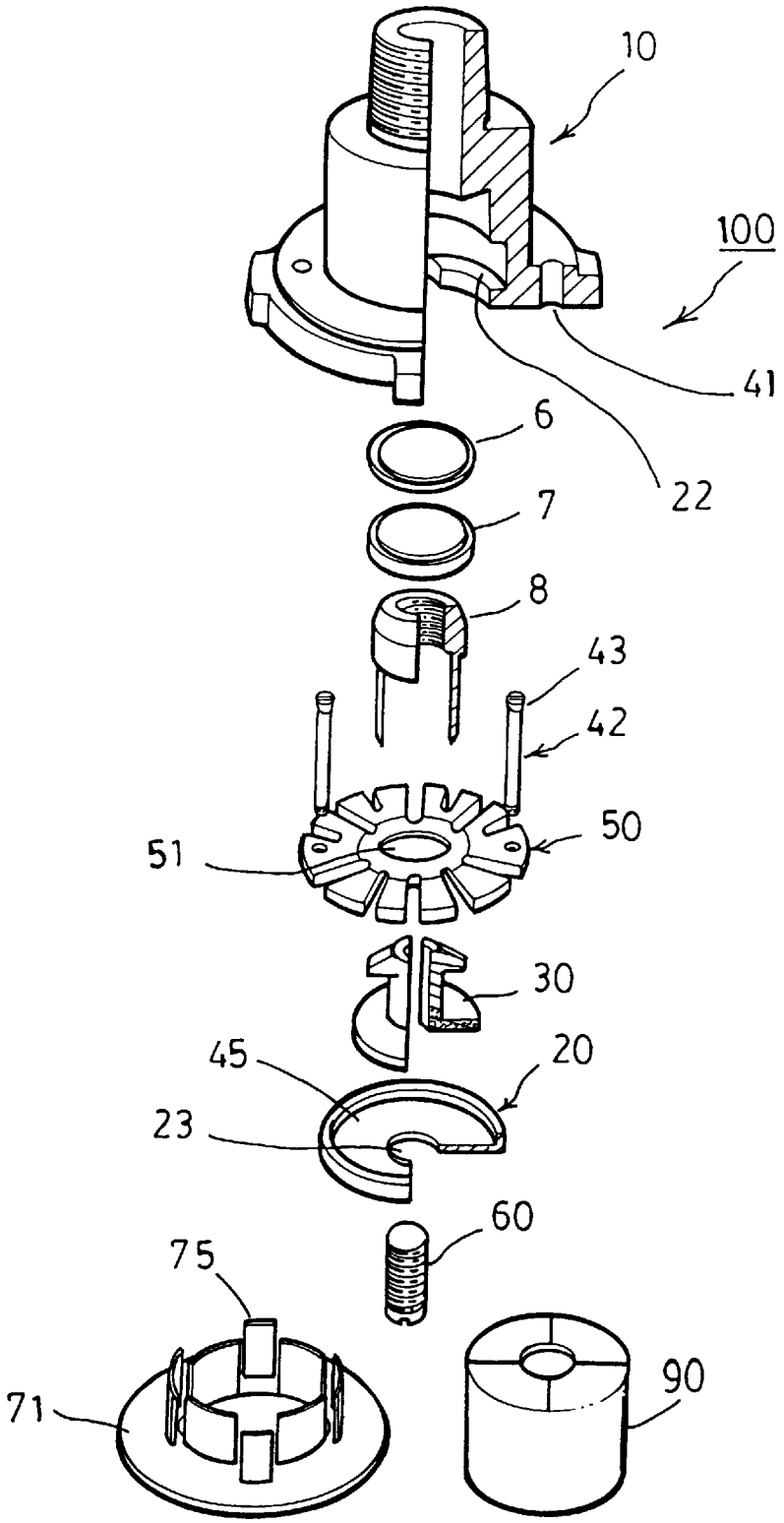
FIG. 1*b* is an exploded perspective view in which main portions of a device of the present invention are broken.
Figure 2:
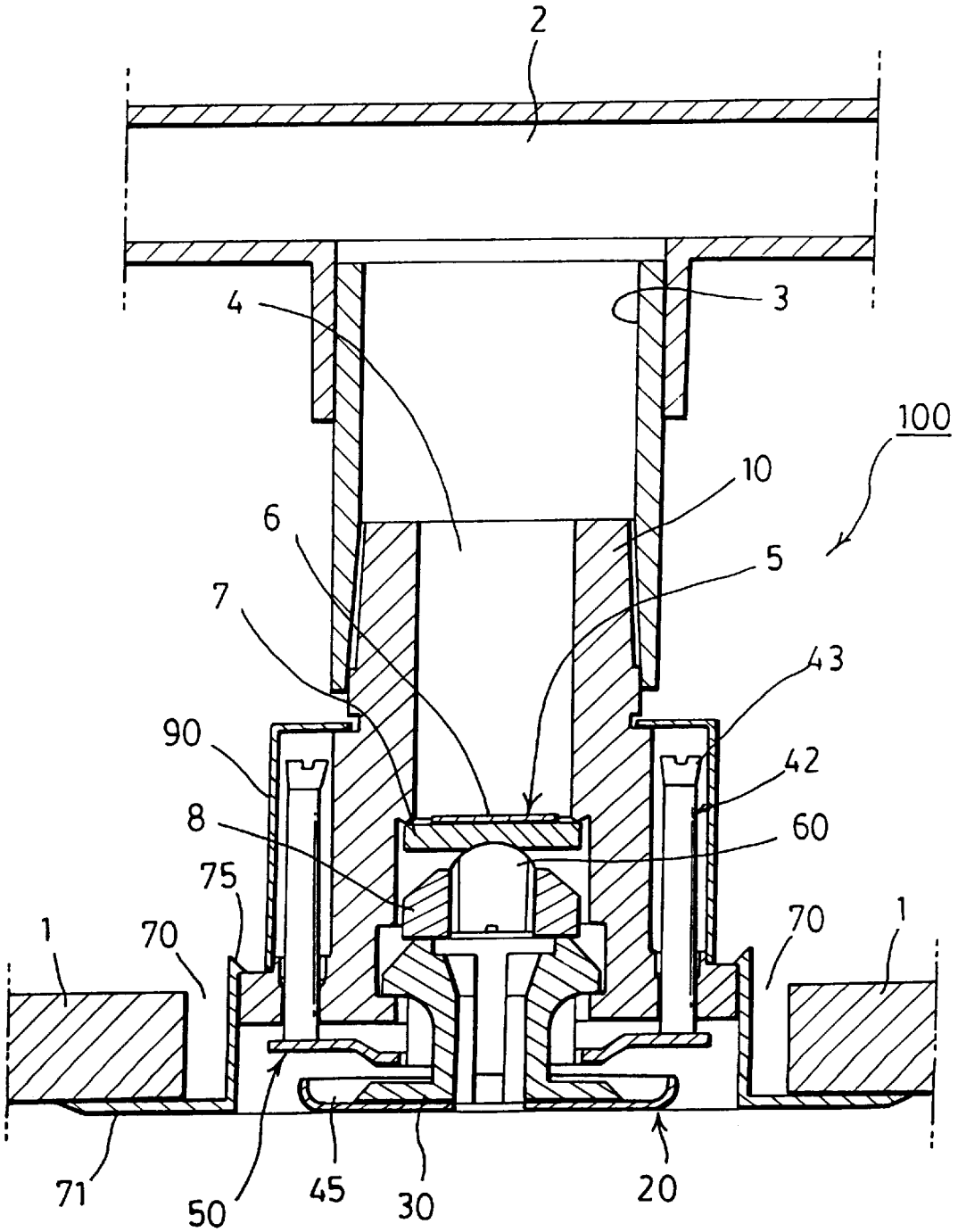
FIG. 2 is an assembled sectional view of a device according to the present invention.
Figure 3:
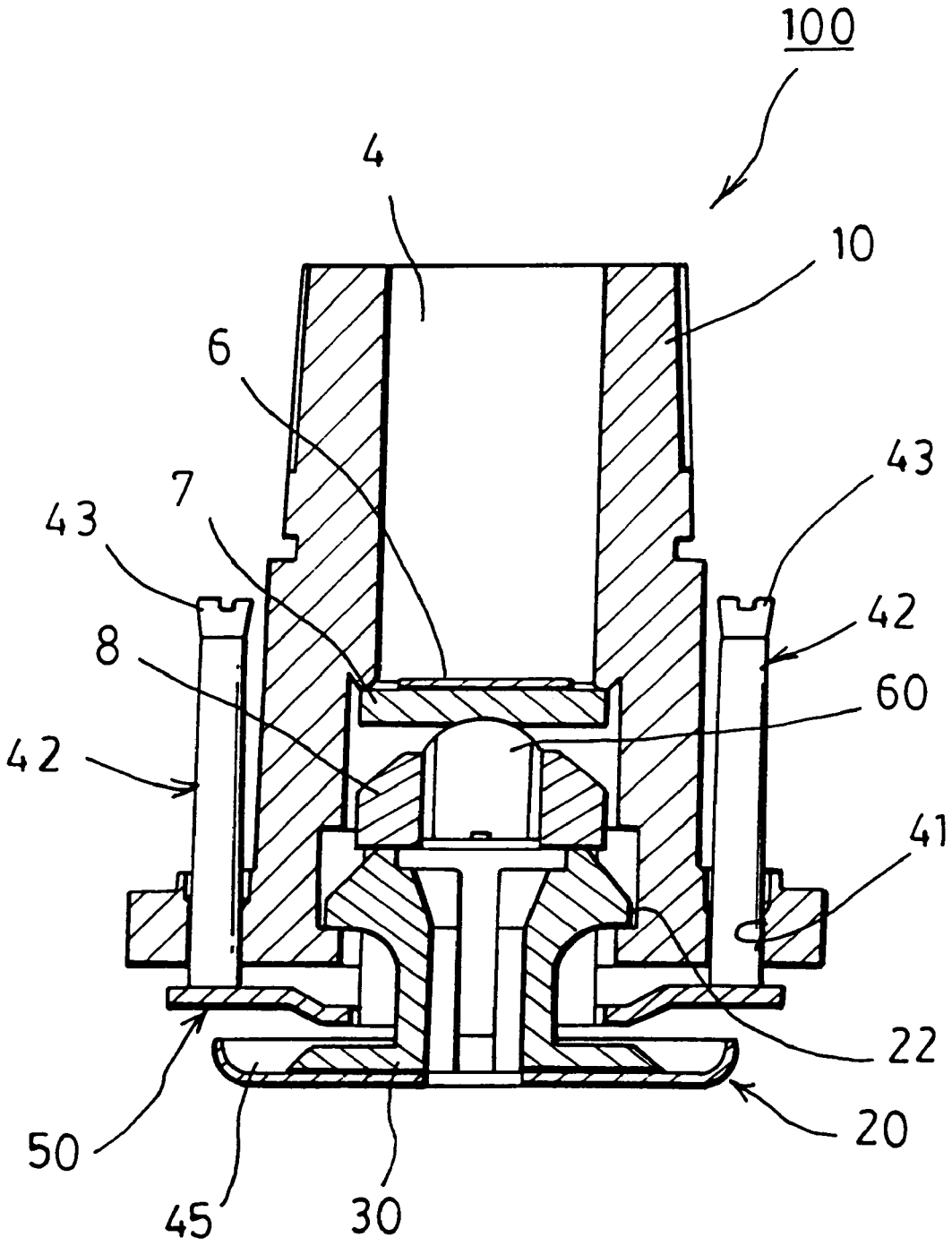
FIG. 3 is a grossly enlarged sectional view for major portions of a device according to the present invention.

Referring now to FIG. 1*a*, FIG. 1*b* and FIG. 2 of the drawings, the pipe line 2 which discharges the continually pressurized water at the time of a fire breakout, the guiding pipe 3 branched off from the pipe line 2, and the sprinkler head body 100 are installed, respectively.

In a lower side and inside of the above mentioned sprinkler head, a heat sensing plate 20 is positioned. The heat sensing plate 20 will melt and separate in accordance with a high temperature. Further, a water spraying plate 50 is also installed.

In the inside of a sprinkler head 10, the packing or blocking plate 6 pasted with the oil-based material is attached to the end portion of an inlet 5 of the discharge path 4. Then a reinforced plate 7 and a nut 8 are assembled with a fastening center bolt 60 and also combined at the inside of the sprinkler head 10.

In connection with the above, after attaching the water spraying plate 50 to the bottom area of the sprinkler head 10, two nut-supporting plates 30 are integrally attached with a heat sensing plate 20 into the heat sensing cup 45 using a lead Pb, for example as a melting material, and also coupled with the nut using a nut accessible slot 21 of the sprinkler head 10. Then each side wing of the nut supporting plate 30 is fixed by turning the plate an approximately 90° angle, so that the side wings can be suspended on a flange 22 of the sprinkler head 10. Finally, a center hole 23 of the heat sensing plate 20 is tightened through a fastening center bolt 60 using a screw driver or the like.

The inlet 5 of a discharge path 4 can be perfectly blocked, since the packing plate 6 and the reinforced plate 7 are upraised by turning the fastening center bolt 60 as shown in FIG. 2.

On the other hand, the water spraying plate bolt 42 which is assembled with the water spraying plate 50, is constructed to be able to move up and down by providing several holes 41 to the main flange of a sprinkler head 10. An inverse triangular jaw 43 is formed on the top of the water spraying plate bolt 42 so as to descend down a certain distance when the water spraying plate 50 descends vertically. Also, a shock prevention cap 90 for the sprinkler head 10 is provided as shown in FIG. 2 or in FIG. 4.

Further, the sprinkler head body 100 is coupled with the guiding plate of the installed pipe line 2 by forming the hole in a ceiling on which the sprinkler head body 100 is provided. The blocking jaw 75 is formed on a finishing ring 71 in the space 70 provided in the sprinkler head body 100, so that the space 70 being produced on the ceiling face can be hidden.

This invention in accordance with the above construction will be below described in operation.

Figure 4:
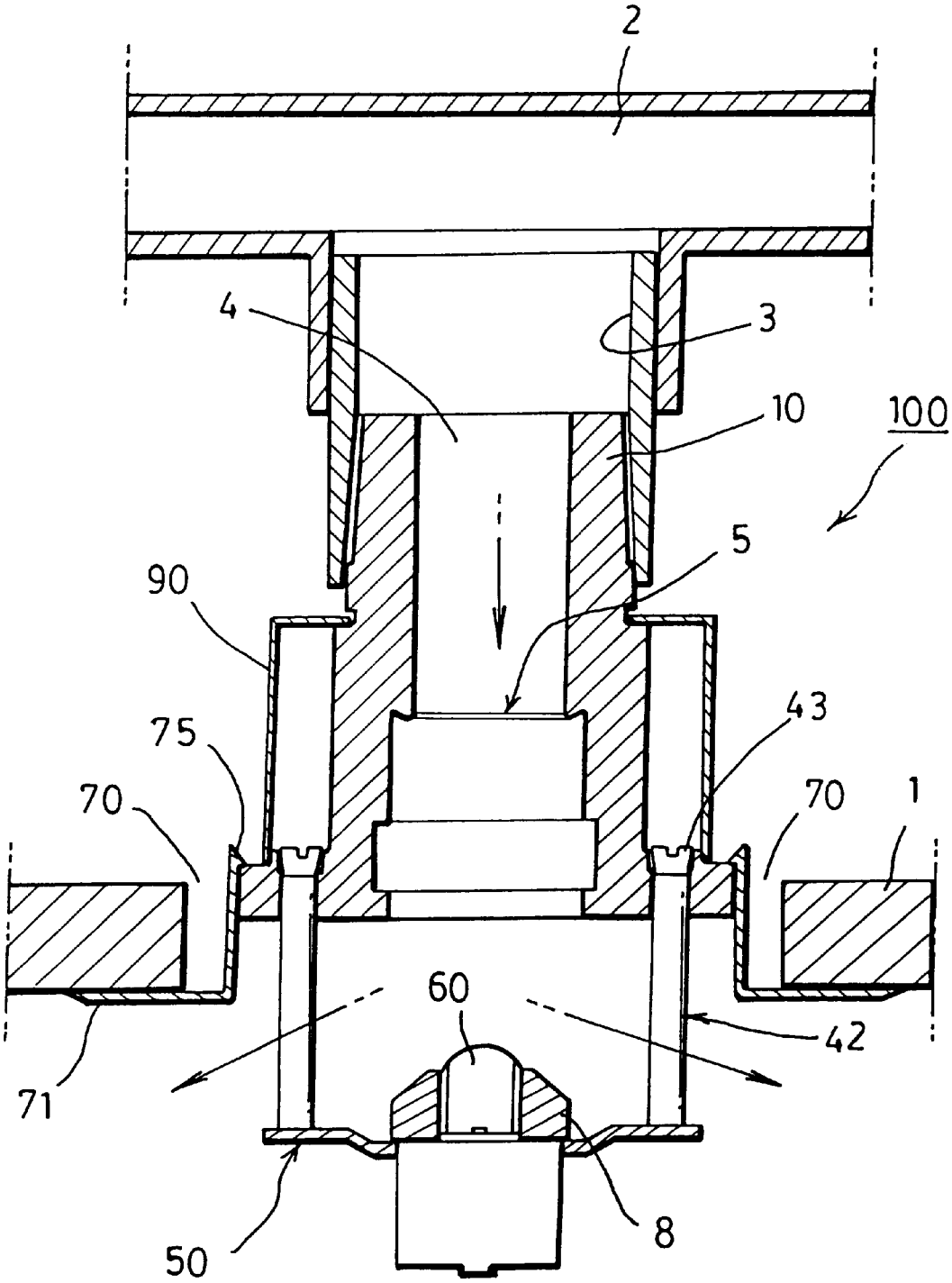
FIG. 4 is a sectional view which shows an operational condition of a device according to the present invention.

FIG. 2 is an assembled sectional view showing a status prior to the actuation of the water spraying plate 50 of the sprinkler head 10 for fire extinguishing. FIG. 4 is a sectional view showing a status where the water spraying plate 50 is actuated.

First, at a fire breakout, the water spraying plate adjusting device will be operated through a heat sensing plate 20 and a nut supporting plate 30 mounted in the sprinkler head body 100. Upon reaching a certain temperature, the lead Pb, such as a melting material attached in the nut supporting plate 30, as shown in FIG. 1*b* is melted and separated from the heat sensing plate 20 to disassemble and drop the nut supporting plate 30 supported by the nut 8. The packing plate 6, the reinforced plate 7 and the nut 8, etc. simultaneously fall down and scatter, as shown in FIG. 4, to discharge down the water of the pipe line 2 arranged in the inside of the ceiling.

Now, the discharged water will flow down along inside discharging path 4 of the guiding pipe 3. At this time the nut 8, which is coupled with a fastening center bolt 60, will block the water spraying plate hole 51, since the nut 8 is located in the hole formed on the central portion of the water spraying plate 50. Therefore, the water being discharged along the discharging path 4 can be uniformly spread all over the wide area.

In addition, the water spraying plate 50 is lowered down due to water pressure. The water spraying plate bolt 42 is slided down and moved up to a certain distance from the sprinkler head 10, and then the water spraying plate 50 will fall down up to a length of the water spraying plate bolt 42 through the triangular jaw 43 formed on the upper area, so that the discharged water will be sprayed to the peripheral portion of the water spraying plate 50 along a discharging path 4 of the guiding pipe 3 to spread uniformly to the wide area.

Accordingly, the sprinkler head body, according to the present invention, can be provided at a plane level in the ceiling, without any protruding portion, and so, in addition to an elegant appearance, the contacting portion between the heat sensing plate and the nut supporting plate is melted, separated and disassembled depending on the increased temperature. Then, at the same time when the water spraying plate falls, a large quantity of the water can be simultaneously sprinkled to suppress a fire effectively in the event a fire occurs.

What is claimed is:

1. A water spraying control unit for a fire extinguishing sprinkler head comprising:

a sprinkler head receiving a branched pipe from a pipe line arranged in the ceiling of a building, said sprinkler head suppressing fire by discharging continuously pressurized water flowing in the branched pipe due to separation and disassembly of a heat sensing plate and a nut supporting plate during a fire breakout, a packing plate blocking the water from being discharged and mounted inside of said sprinkler head, a reinforced plate and a nut joined by a fastening center bolt coupled in said sprinkler head, and a water spraying plate joined with a water spraying plate bolt, said water spraying plate bolt capable of moving through a through hole of a protruding portion outside of said sprinkler head, wherein said heat sensing plate is assembled with said nut supporting plate, a nut accessible slot of said sprinkler head providing access for two wings of said nut supporting plate, the two wings of said nut supporting plate mounted on a flange of the sprinkler head for suspending said nut supporting plate, and said center bolt is capable of being tightened through a center hole of said heat sensing plate by a screw driver, wherein, during a fire breakout, said sprinkler head discharges a large quantity of water over a wide area, said sprinkler head discharging water through a guiding pipe that is lowered down a distance up to a length of said water spraying plate bolt, said water spraying plate being fixed by inserting said nut in a center hole of said water spraying plate, water flowing from said sprinkler head due to separation and disassembly of said heat sensing plate and said nut supporting plate.

2. The water spraying control unit of claim 1, wherein, before operation of said control unit, said heat sensing plate is at approximately the same height as a ceiling receiving the control unit, and after actuation said water spraying plate extends downwardly below the ceiling.

3. A water spraying control unit for a fire extinguishing sprinkler head comprising:

a) a sprinkler head having a first end for securement to a guiding pipe branched from a pipe line and a second end;

b) a reinforced plate coupled in said sprinkler head by a fastening center bolt;

c) a water spraying plate joined with a water spraying plate bolt, said water spraying plate bolt movable through a through hole of a protruding portion outside of said sprinkler head;

d) a heat sensing plate below said water spraying plate; and e) a nut supporting plate capable of passage through a nut accessible slot in said sprinkler head, two wings of said nut supporting plate being mounted on a flange for suspending said nut supporting plate, at least a portion of said nut supporting plate comprising a melting material;

wherein, during a fire, the material comprising at least a portion of said nut supporting plate melts and said nut supporting plate and said heat sensing plate drop from said sprinkler head enabling said water spraying plate to move downwardly and protrude from said sprinkler head, said sprinkler head discharging a large quantity of water over a wide area, said water spraying plate being lowered downward a distance up to a length of said water spraying bolt, said water spraying plate being fixed by inserting a nut in a center hole of said water spraying plate, the water flowing from said sprinkler head due to separation and disassembly of said heat sensing plate and said nut supporting plate.

4. The water spraying control unit of claim 3, wherein said heat sensing plate is secured to said nut supporting plate.

5. The water spraying control unit of claim 3, including a packing plate mounted inside of said sprinkler head, said packing plate and said reinforced plate preventing water from spraying from said sprinkler head until said nut supporting plate drops.

6. The water spraying control unit of claim 3, wherein, before operation of said control unit, said heat sensing plate is at approximately the same height as a ceiling receiving the control unit, and after actuation said water spraying plate extends downwardly below the ceiling.

7. A water spraying control unit comprising:

a) a sprinkler head for receiving a guiding pipe from a pipe line arranged in the ceiling of a building, said sprinkler head having a nut accessible slot;

b) a packing plate mounted inside of said sprinkler head for blocking water from being discharged;

c) a reinforced plate and a nut in said sprinkler head;

d) a water spraying plate joined with a water spraying plate bolt, said water spraying bolt having a length;

e) a heat sensing plate; and f) a nut supporting plate, capable of passage through said nut accessible slot;

wherein, during fire breakout, said sprinkler head is lowered downwardly about the length of said water spraying bolt and said sprinkler head discharges a large quantity of the water over a wide area.

8. A water spraying control unit of claim 7, wherein two wings of said nut supporting plate are received in the nut accessible slot of said sprinkler head.

9. A water spraying control unit of claim 7, said water spraying plate protruding outside of said sprinkler head when the control unit is installed.

10. The water spraying control unit of claim 7, wherein, before operation of said control unit, said heat sensing plate is at approximately the same height as a ceiling receiving the control unit.

11. The water spraying control unit of claim 7, wherein said heat sensing plate is coupled to said nut supporting plate, said heat sensing plate being capable of melting and separating from said nut supporting plate to trigger said water spraying control unit.

12. The water spraying control unit of claim 11, wherein said nut supporting plate comprises first and second spaced nut supporting plates attached to said heat sensing plate.

13. The water spraying control unit of claim 7, wherein at least a portion of said nut supporting plate is capable of melting and separating from said heat sensing plate to trigger said water spraying control unit.

14. The water spraying control unit of claim 13, wherein said nut supporting plate comprises first and second spaced nut supporting plates attached to said heat sensing plate.

15. The water spraying control unit of claim 7, wherein said nut supporting plate and said heat sensing plate are both capable of melting and separating to trigger said water spraying control unit.

16. The water spraying control unit of claim 7, wherein the nut is supported by said nut supporting plate and said nut supporting plate extends through the nut accessible slot and is supported by a flange of said sprinkler head.

17. The water spraying control unit of claim 16, wherein said nut supports said blocking plate and said reinforced plate, to prevent operation of the water spraying control unit.

* * * * *